United States Patent [19]

Sullivan

[11] 4,345,593

[45] Aug. 24, 1982

[54] PRESSURE-DEMAND BREATHING APPARATUS WITH AUTOMATIC AIR SHUT-OFF

[75] Inventor: John L. Sullivan, Fort Erie, Canada

[73] Assignee: A-T-O Inc., Willoughby, Ohio

[21] Appl. No.: 231,994

[22] Filed: Feb. 6, 1981

Related U.S. Application Data

[63] Continuation of Ser. No. 926,004, Jul. 19, 1978, abandoned.

[51] Int. Cl.[3] ..... A62B 7/04

[52] U.S. Cl. ..... 128/204.26; 128/205.24; 137/DIG. 9; 137/498; 137/462

[58] Field of Search ..... 128/204.26, 204.27, 128/205.24; 137/460, 462, 494, 498, DIG. 9

[56] References Cited

U.S. PATENT DOCUMENTS

| | | | |
|---|---|---|---|
| 374,485 | 12/1887 | McGann | 137/462 |
| 2,406,888 | 9/1946 | Meidenbauer, Jr. | 128/204.26 |
| 2,623,725 | 12/1952 | Sands | 251/118 |
| 2,699,799 | 1/1955 | Wager | 137/498 |
| 2,970,602 | 2/1961 | Cupp | 137/DIG. 9 |
| 3,085,589 | 4/1963 | Sands | 137/498 |
| 3,122,162 | 2/1964 | Sands | 137/498 |
| 3,189,027 | 6/1965 | Bartlett, Jr. | 128/205.24 |
| 3,724,482 | 4/1973 | Ekstrom | 128/204.26 |
| 3,756,272 | 9/1973 | Hammond | 137/498 |
| 4,049,016 | 9/1977 | Henry | 137/498 |
| 4,140,112 | 2/1979 | Kobzan | 128/204.26 |
| 4,188,971 | 2/1980 | Otteson | 137/462 |
| 4,274,404 | 6/1981 | Molzan et al. | 128/204.26 |

FOREIGN PATENT DOCUMENTS

| | | | |
|---|---|---|---|
| 2406307 | 8/1975 | Fed. Rep. of Germany | 128/204.26 |
| 1401613 | 7/1975 | United Kingdom | 128/204.26 |

*Primary Examiner*—Henry J. Recla

*Attorney, Agent, or Firm*—Christel, Bean & Linihan

[57] ABSTRACT

A face mask is connected to a source of breathing fluid through a pressure-demand regulator and a supply line. The regulator admits breathing fluid to the mask on demand and maintains a positive pressure within the mask at all times to prevent inflow from the surrounding atmosphere. The regulator has a flow capacity considerably greater than that normally required, even when gasping or breathing heavily. An automatic shut-off device in the supply line upstream of the regulator permits the peak flow of a predetermined breathing requirement but is responsive to abnormal flow conditions, as for example where the mask is removed from the wearer, to close the supply line and thereby prevent wasting of the air breathing fluid supply. The apparatus can be manually reset to normal operation and will reset itself after the mask is repositioned on the wearer.

7 Claims, 5 Drawing Figures

Fig. 4.
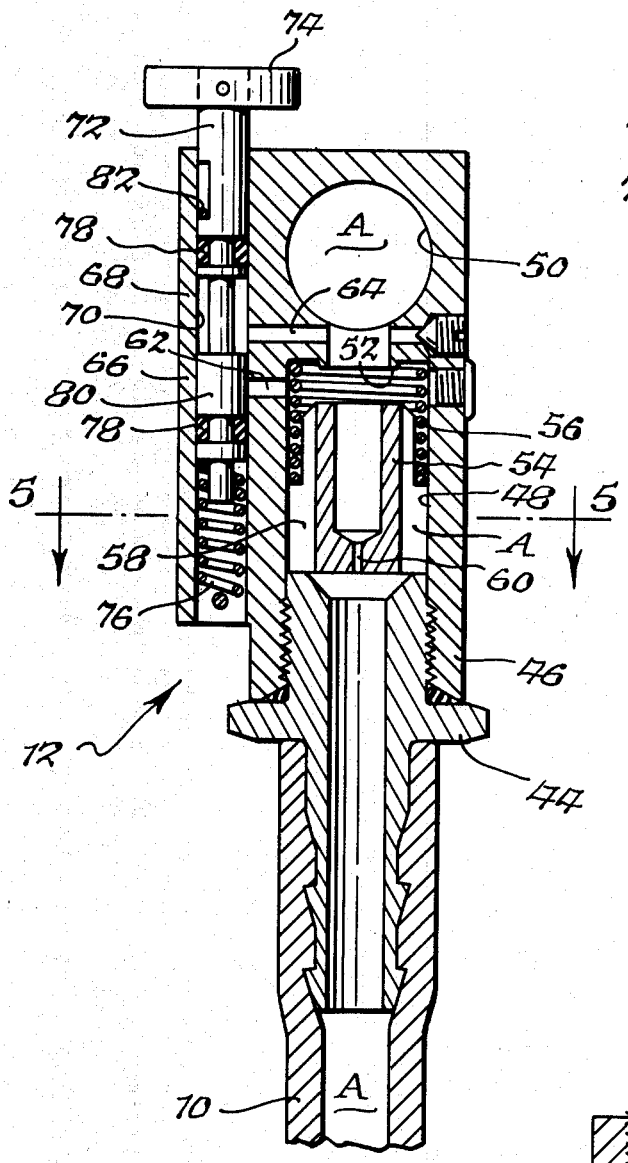
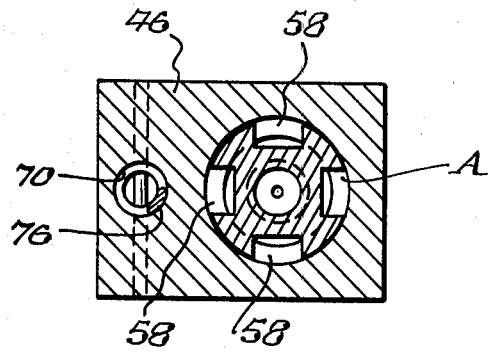
Fig. 5.
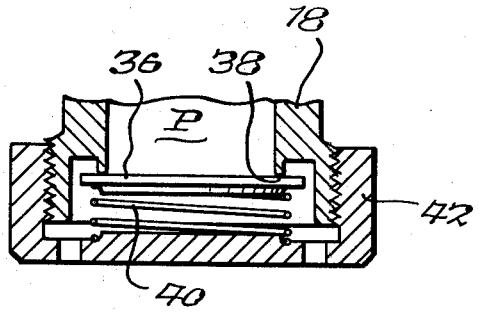
Fig. 3.

PRESSURE-DEMAND BREATHING APPARATUS WITH AUTOMATIC AIR SHUT-OFF

This application is a continuation of application Ser. No. 926,004, filed July 19, 1978, now abandoned.

BACKGROUND OF THE INVENTION

This invention relates to protective breathing apparatus of the type in which a user wears a face mask, sometimes referred to as a respiratory inlet covering, communicating with a source of air or other breathing fluid for use in toxic or oxygen deficient surroundings.

In the use of such breathing equipment, it is mandatory that pressure-demand apparatus be used where the atmosphere is highly toxic. Pressure-demand apparatus provides air on demand and in addition maintains a positive pressure within the face mask in relation to the ambient environment, during both inhalation and exhalation, thereby assuring that any leakage caused by poor facepiece fit or component failure will be outward from the mask to prevent inflow and possible inhalation of the atmosphere. However, a pressure demand regulator that will function as above will open to full flow position at all times that the users' face (or other means) does not close the man side of the mask to stop the flow and permit the build-up of positive pressure. If air is supplied to the regulator at such times it will deliver its maximum flow capacity, quickly depleting and wasting the air supply.

The evolution of user and buyer requirements as well as those of various regulatory agencies has seen an upward spiral of flow requirements such that modern regulators, in fully open position, can discharge enormous quantities of air as compared to the normal breathing requirements of a man. Over 500 liters per minute (17.6 cfm) is not unusual as a free flow regulator performance although the minimum approved quantity is 200 liters per minute. During donning and doffing or inadvertant removal of the mask this high flow will occur unless the air supply is off. It is difficult to don or doff and simultaneously turn the air on or off, and if the mask is forced off the wearers' face, for example during a fall, he may not be in a condition to immediately refit the mask or manually shut off the air supply. It is therefore desirable, and the object of this invention, to provide an automatic shut-off of the air supply in such situations where mask back pressure is lacking to prevent escape and rapid wasteful depletion of the limited air supply.

The details, operation, and benefits of the present invention will be described in detail with reference to the accompanying drawings.

THE DRAWINGS

FIG. 3 is a sectional view of the exhalation valve on the face mask in FIG. 1.

FIG. 4 is a longitudinal sectional view of the automatic shut-off valve component of the apparatus.

FIG. 5 is a transverse sectional view of the shut-off valve, taken along line 5—5 of FIG. 4.

DESCRIPTION

Figure 1:
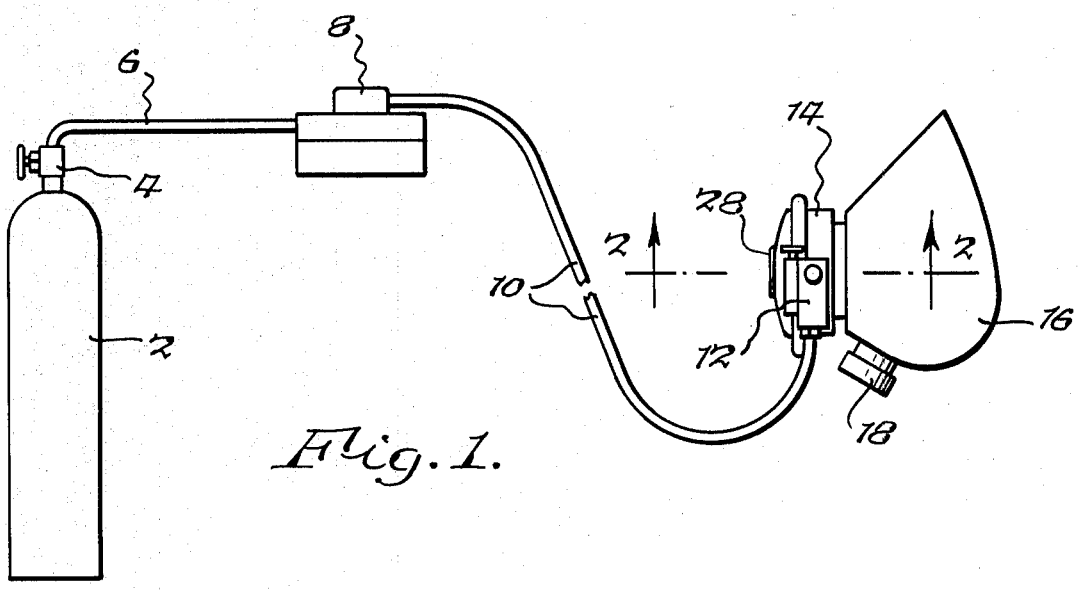
FIG. 1 is a somewhat schematic representation of a breathing apparatus according to this invention, the supply line being broken away to indicate indeterminate length.

FIG. 1 shows a tank 2 of air or other breathing fluid under pressure, with a hand operable shut-off valve 4. A high pressure air line 6 leads from the source 2 to a first stage regulator 8 which reduces the high pressure air from the source 2 to an intermediate level, typically 100–150 psig. An intermediate pressure air line 10 leads from regulator 8 to an automatic shut-off device 12, which is mounted on and communicates with the inlet side of a pressure-demand regulator 14. However, the shut-off device 12, sometimes known as a pneumatic fuse or excess flow valve, also can be located at the discharge side of regulator 8 or at any point in supply line 10 between regulators 8 and 14.

Regulator 14 is mounted on a face mask 16, which also has an exhalation valve 18 mounted on it. Face mask 16 is contoured to fit against the face of a wearer, not shown, and provides a mask chamber defined by the mask and facial portion covered thereby, in a manner well known in the art.

Figure 2:
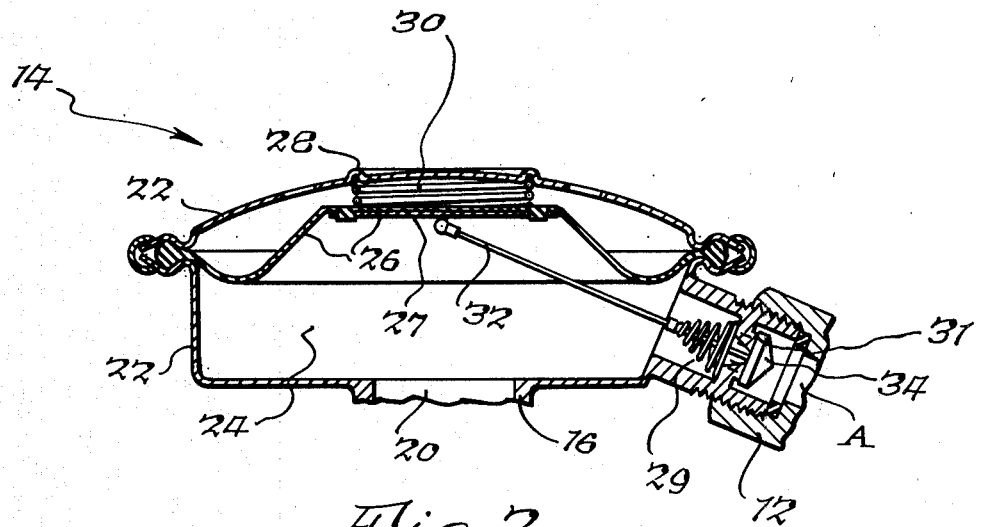
FIG. 2 is a sectional view of the pressure-demand regulator component of the apparatus, taken along line 2—2 of FIG. 1.

Referring to FIG. 2, the mask chamber is at the desired positive pressure and the pressure-demand regulator 14 is shown in closed position. Regulator 14 communicates with the mask chamber through inhalation aperture 20. Regulator 14 includes a body or casing 22 enclosing a regulator chamber 24 which is partitioned by flexible diaphragm 26. Diaphragm 26 is biased inwardly of chamber 24 by a spring 30 seated in an annular recess 28 in the cover of casing 22 and bearing against the diaphragm which has a reinforcing member 27. A tilt valve stem 32 is engaged by diaphragm 26 for movement thereby to open the demand valve 34 and admit air into chamber 24 from air passage A.

Spring 30 biases diaphragm 26 to open valve 34 whenever the relative pressure within chamber 24 drops below the positive pressure desired to be maintained, the spring bias being overcome when chamber 24 is at the desired pressure to permit spring 29 to tilt stem 32 to its centered position with valve body 34 closed against seat 31. The force of spring 30 therefore determines the positive pressure maintained in chamber 24, which of course is the same as the pressure in the mask chamber, and spring 30 is selected accordingly. If desired, means can be provided to adjust the biasing force of spring 30. Such means are known in the pressure-demand regulator art and, being no part of this invention, are not shown.

In normal operation, upon inhalation diaphragm 26 moves inwardly because of the resulting drop in pressure within chamber 24 and the mask chamber. As it moves inwardly, diaphragm 26 tilts stem 32 against the bias of its centering spring 29 to open valve 34 and admit air under pressure into the regulator chamber 24 and through passage 20 to the mask chamber and the user. Valve 34 will remain open between inhalation and exhalation and during exhalation until the pressure within the regulator chamber 24 and the mask chamber reaches the positive pressure level determined by the biasing action of spring 30, at which level diaphragm 26 will have moved to a position permitting spring 29 to close the tilt valve. Continued exhalation will raise the pressure above the predetermined positive pressure to be maintained in the mask, opening the exhalation valve 18 and permitting exhalation to the ambient atmosphere.

Exhalation valve 18 is a check valve, opening for outward air flow or exhalation, and closing to prevent inflow or inhalation through the valve. As shown in FIG. 3, a floating disc 36 is lightly biased against a valve seat 38 by a valve spring 40, sufficient to hold valve disc 36 seated against the positive pressure for which the regulator is pre-set by spring 30. Disc 36, when seated, blocks the valve passage P during inhalation by the wearer. During exhalation, the additional pressure within the mask caused by the exhalation moves disc 36 against spring 40 to open passage P for exhalation to atmosphere. An apertured cover 42 threads onto the body of valve 18 to hold spring 40 and disc 36 in place, and also to adjust the closing bias force on the valve by varying the compression of spring 40. This permits adjustment of the pressure required to open the exhalation valve to a level greater than the positive pressure being maintained within the mask chamber.

Whenever the pressure in the mask chamber, as reflected in the regulator chamber 24 drops below the predetermined positive pressure desired to be maintained, diaphragm 26 will move inwardly, causing valve 34 to open. This creates a serious problem if the mask is removed from the face, because the pressure-demand regulator will move to a wide-open, full-flow position with the result that a substantial quantity of air will be lost and, if permitted to continue, the air supply will be quickly depleted. This can occur, for example if the mask is knocked from the face of a fireman during a fall and he is unconscious and unable to manually turn off the air supply. However, it is a particular feature of this invention that under such abnormal flow conditions the supply of air will shut off automatically.

FIG. 4 shows in sectional detail the automatic shut-off device 12 which is located in the supply line 10 upstream of the pressure demand regulator 14. A suitable hose fitting 44 connects air line 10 to shut-off valve 12 and continues the air passage A from line 10 into valve 12. Passage A at the top portion of FIG. 4 leads directly into the regulator 14 as shown in FIG. 2.

Valve 12 includes a body 46 in which a generally cylindrical passage or bore 48 is formed. Passage 48, open to the source end of valve 12, leads into a second passage 50 which is open to the regulator end of valve 12. Passages 48 and 50 are part of the total air passage A through the system. Body 46 is configured to form a valve seat 52 near the interior end of passage 48 through which it leads into passage 50.

A valve poppet 54 is axially movable in passage 48 between a seated closed position against valve seat 52 and a wide open position abutting the hose fitting 44. FIG. 4 shows the poppet 54 in its unseated, wide-open position, the position it takes during normal operation of the system, permitting free air flow through passage A. A compression spring 56 is disposed between poppet 54 and the valve body 46 around the valve seat 52 to bias the poppet 54 away from the valve seat to the normally open position shown. A plurality of grooves 58 extend axially along the exterior of poppet 54 and form a part of air passage A. A small bleed orifice 60 is formed through the poppet 54 to permit a restricted flow of air through the valve even when poppet 54 is seated.

A pair of parallel reset ports 62 and 64 extend radially outward from passage 48, one upstream and the other downstream of the valve seat 52. A reset spool valve 66 is associated with the shut-off 12 and is shown in its inoperative or standby position during normal system operation. Spool valve 66 includes a body 68 defining a longitudinal passage 70 which communicates with reset ports 62 and 64. The reset valve 66 may be formed of the same body 46 as the associated shut-off valve 12 as shown, but this is not essential. Reset valve stem 72, including a hand actuator 74 at its outer end, is axially movable within the passage 70, against the bias of a compression spring 76, between an inoperative position as shown and an operative position. Valve stem 72 includes suitable air seals such as O rings 78 located along passage 70 outward in each direction from the reset ports 62 and 64. Valve 72 also includes a valve spool 80. In the illustrated inoperative position of reset valve 66, valve spool 80 covers port 62 to block communication of port 62, which is on the upstream of valve seat 52, with port 64 which is on the downstream side of seat 52. A stop 82, in the form of a pin engagable with the opposite ends of an elongated groove in stem 72, limits the axial travel of valve stem 72. The extreme outward position of the stem is shown; the inward or reset position is that position where valve spool 80 uncovers reset port 62 connecting it with port 64 through passage 70.

OPERATION

In normal operation, shut-off device 12 is open and air is pressure-demand regulated to the face mask and wearer. In the event that the mask is forced from the wearer, the mask internal pressure is lost and it appears to the regulator as a continuing unlimited demand situation. Diaphragm 26 moves inwardly, tilting valve 34 to its full wide open position to provide full flow of air in a futile attempt to restore the predetermined positive pressure to the mask chamber. Normally this would result in rapid depletion of the air supply. For example what normally would be a thirty minute supply can be exhausted in two minutes under such wide open, free flowing conditions. However, such wasteful loss is prevented by the action of the automatic shut-off 12. As soon as this extraordinary, abnormal flow occurs, the normal pressure differential across the valve 12 becomes a significantly greater pressure drop. The large drop in pressure on its downstream side causes poppet 54 to move quickly to its seated closed position, i.e. to slam shut, thereby preventing further loss and conserving the air supply. Once poppet 54 closes, the only loss of air is a small bleed flow through orifice 60. The upstream air pressure acting against the complete end face area holds poppet 54 closed.

When the mask is refitted on the wearer, the shut-off 12 can be reset by momentarily depressing the actuator 74. This puts port 62, which is on the pressure side of valve seat 52, in communication with port 64 and passage A on the downstream side. The pressure on the downstream side quickly builds up to a level permitting valve poppet 54 to spring back to its open position permitting normal air flow to the mask. Resetting also would occur automatically, upon refitting the mask in place because of accumulating downstream pressure by air flowing through the bleed orifice 60 without any operator action. While the manual reset is part of the preferred embodiment of this invention, shut-off and reset will occur automatically without it. When a manual reset is provided, the automatic reset is not essential and bleed 60 can be omitted whereby the air supply to the mask will be completely shut off when device 12 closes.

SUMMARY

To prevent a run away of air supply when for some reason the mask is separated from the wearer, a pneumatic fuse automatic shut-off is interposed in the system to sense the attendant extraordinary pressure conditions and to react by closing the air system. The shut-off device resets or can be manually reset to its normally open condition when the mask is refitted on the wearer.

The pressure drop occurs across both the shut-off 12 and the fully open pressure demand regulator 14. Therefore, it is most important that the pressure drop at the demand regulator be a small percentage of the total pressure drop when it is fully open (i.e. facemask removed), but that it represents a significant part of the total pressure drop when the breathing apparatus is in use. A pressure demand regulator with a flow capacity considerably greater than that normally used by the wearer is necessary for the shut-off device to differentiate between a deep breath or gasp by the wearer or removal of the facepiece. For example, if a maximum flow capacity of 500 liters per minute is required for normal operation, a regulator having a capacity of up to 700 liters per minute will be used with the shut-off 12 adjusted or selected to close at a flow rate between 500 and 700 liters per minute. The "fuse" would be set to flow enough to supply the peak flow of a predetermined breathing requirement but would be designed to close at a flow under the maximum free flow discharge.

Fuse closing characteristics are flexible and optimum performance can be obtained by varying the poppet cylinder bore, effective orifice size around poppet, spring force and rate, poppet travel and the diameter of the closing seat.

The reopening characteristics are a function of the spring, closing seat size, orifice bleed flow, volume downstream of the fuse and the flow demand placed on the pressure demand regulator. For optimum reopening performance, the pressure demand requirements should approach zero flow during opening cycle.

The term "air" has been used throughout for simplicity of description. It will be appreciated that there may be appropriate circumstances where the breathing fluid is not, strictly speaking, "air" but oxygen, or a mixture of oxygen and other gases. The term "air" in this specification and the following claims is therefore intended to include all such fluids as are used in respiratory systems. The term "mask" is intended to include any appropriate respiratory inlet covering.

The foregoing description and summary of this invention are given only by way of illustration and not of limitation. The concept and scope of the invention are intended to be limited only by the purview of the following claims.

What is claimed is:

1. In a pressure-demand breathing apparatus including a face mask providing a mask chamber when fitted against the face of a wearer and means including an air supply line for connecting said mask to a pressurized air supply, a pressure demand regulator positioned in said air supply line between said face mask and said air supply, said pressure-demand regulator including means responsive to pressure within said mask chamber for admitting said pressurized air to said mask chamber at flow rates required for normal breathing or abnormally deep breathing when said mask is worn and for maintaining a predetermined positive pressure in the mask chamber above the ambient pressure when said mask is worn, said regulator also admitting said pressurized air to said mask at a predetermined high air flow rate substantially greater than that required either for normal breathing or for abnormally deep breathing when said mask is removed, the improvement comprising shut-off means positioned between said pressure-demand regulator and said air supply, said shut-off means being responsive to said predetermined high air flow rate through said pressure demand regulator which exceeds that required even for abnormally deep breathing for automatically interrupting the supply of air to said mask under unrestricted flow conditions such as occurs when the mask is removed from the face of a wearer and is open to the ambient atmosphere, whereby said shut-off means is inoperative during normal breathing and during abnormally deep breathing when the mask is worn but only becomes operative when the flow therethrough exceeds the flow which occurs during abnormally deep breathing so that sufficient air is supplied to the wearer at all times when said mask is worn but the air supply is shut off when said mask is removed, to thereby prevent unwanted depletion of said air supply.

2. Apparatus as defined in claim 1, said shut-off means having automatic reset means for restoring the supply of air to said mask when said mask is worn by the user.

3. Apparatus as defined in claim 1, said shut-off means having means for automatic resetting to its normally open position when air pressure in said mask chamber is restored to a normal operating level when said mask is worn.

4. Apparatus as defined in claim 1 wherein said shut-off means includes means for manual resetting to its normally open position, said manual resetting means including valve means movable from a position blocking by-pass flow around said shut-off valve means to a position permitting by-pass flow therearound to reduce the pressure differential across said shut-off means whereby said shut-off means is restored from its closed to its open position.

5. Apparatus as set forth in claim 1, said shut-off means having a spring-biased poppet valve.

6. Apparatus as defined in claim 1, said shut-off means operating in response to a flow rate through said regulator exceeding the peak flow of a predetermined breathing requirement.

7. Breathing apparatus as set forth in claim 1, wherein a pressure drop occurs across both said shut-off means and said regulator when in use, the pressure drop across the regulator being a small percentage of the total pressure drop under abnormal flow conditions and representing a significant part of the total pressure drop under normal conditions of use.

* * * * *